US010433662B2

(12) United States Patent
Distefano et al.

(10) Patent No.: US 10,433,662 B2
(45) **Date of Patent: *Oct. 8, 2019**

(54) BLANKET-BASED STRUCTURES

(71) Applicant: Distefano Solutions, LLC, Saratoga Springs, UT (US)

(72) Inventors: Kris Distefano, Saratoga Springs, UT (US); Vennessa Distefano, Saratoga Springs, UT (US)

(73) Assignee: Distefano Solutions, LLC, Saratoga Springs, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/355,541

(22) Filed: Mar. 15, 2019

(65) Prior Publication Data

US 2019/0208934 A1 Jul. 11, 2019

Related U.S. Application Data

(63) Continuation of application No. 15/442,262, filed on Feb. 24, 2017, now Pat. No. 10,307,002.

(51) Int. Cl.

| | |
|---|---|
| ***A47G 9/02*** | (2006.01) |
| ***A63H 33/00*** | (2006.01) |
| ***E04H 15/00*** | (2006.01) |

(52) U.S. Cl.

CPC ..... *A47G 9/0223* (2013.01); *A63H 33/008* (2013.01); *E04H 15/00* (2013.01); *E04H 15/006* (2013.01)

(58) Field of Classification Search

CPC ..... A47G 9/0207; A47G 27/0481; A63H 33/008; E04H 15/006; E04H 15/18

See application file for complete search history.

(56) References Cited

U.S. PATENT DOCUMENTS 3,508,285 A * 4/1970 Marquette ..... A47G 9/023 5/486
4,489,451 A * 12/1984 Neely ..... A47C 29/003 135/121
4,573,227 A * 3/1986 Prandina ..... A47G 9/0207 5/486

(Continued)

OTHER PUBLICATIONS http://www.thehappykidcompany.com/fortamajig.html.

(Continued)

*Primary Examiner* — Eric J Kurilla
(74) *Attorney, Agent, or Firm* — Workman Nydegger

(57) ABSTRACT

Systems and kits for assembling and/or modifying a blanket-based structure are disclosed. An exemplary system includes an enclosure element having one or more attachment mechanisms fixedly attached to the enclosure element and configured to detachably associate with one or more environmental structures. The exemplary system additionally includes a plurality of connection features, a plurality of complementary connection, and a plurality of eyelets disposed along the perimeter of the enclosure element. The exemplary system additionally includes one or more weights selectively attachable to the enclosure element at one or more of: the attachment mechanisms, the plurality of connection features, the plurality of complementary connection features, the plurality of eyelets, or combinations thereof.

20 Claims, 4 Drawing Sheets

(56) References Cited

U.S. PATENT DOCUMENTS 4,631,765 A * 12/1986 Casey ..... A47G 9/0207 428/33
5,069,623 A * 12/1991 Peat ..... G09B 1/06 434/260
5,769,106 A * 6/1998 Achuff ..... A41D 15/04 135/95
6,155,280 A * 12/2000 Powell ..... E04H 15/18 135/119
6,443,794 B2 * 9/2002 Oren ..... A63H 33/00 446/227
8,029,426 B2 * 10/2011 Sohn ..... A63B 23/0211 482/140
2003/0160225 A1 * 8/2003 Osipovs ..... E04H 17/16 256/45
2006/0026758 A1 * 2/2006 Corral ..... A47G 9/062 5/420
2007/0062567 A1 * 3/2007 Warner ..... E04H 15/18 135/97
2008/0099060 A1 * 5/2008 Stocking ..... A63H 33/008 135/115
2008/0207087 A1 * 8/2008 Stocking ..... A63F 3/00533 446/487
2009/0294075 A1 * 12/2009 Huck ..... A63H 33/008 160/127

OTHER PUBLICATIONS https://www.amazon.com/Be-Amazing-Toys-Build-Green/dp/B002NECEVE/ref=sr_1_1?s=toys-andgames&ie=UTF8&qid=1487875887&sr=1-1&keywords=be+amazing+toys+build+a+fort.
United States Office Action for U.S. Appl. No. 15/442,262 dated Feb. 7, 2019.
United States Notice of Allowance for U.S. Appl. No. 15/442,262 dated Apr. 9, 2019.

* cited by examiner

BLANKET-BASED STRUCTURES

This application is a continuation of U.S. patent application Ser. No. 15/442,262, filed Feb. 24, 2017, and entitled "BLANKET-BASED STRUCTURES," which is incorporated by reference herein in its entirety.

BACKGROUND

Technical Field

This disclosure relates generally to systems for creating blanket-based structures and kits for the assembling and/or modifying the same.

Related Technology

Children are amazing creatures. They are endowed with seemingly unending optimism, energy, and creativity. Packed inside their formative minds are endless worlds and possibilities, all fueled by an unparalleled imagination and a steady diet of peanut butter and jelly sandwiches and macaroni and cheese. All of this is wrapped up and pointed at what is almost a singular desire in life—to play. It is not uncommon for children to focus their imagination on a simple, mundane item and transform it into a desirable toy for hours of entertainment.

For example, children have routinely used their imaginative minds to unveil an impossible world of adventure—whether it is forging the storied Excalibur from a simple knobby stick to duel invisible swordsmen in the backyard, racing down an unseen track in a cardboard-box-turned-racecar, or galloping through the dusty American West on a broom handle envisioned as their trusty steed. This uncanny ability to utilize a single prop as inspiration for playtime fun is not limited to the use of minor, mundane items like sticks, boxes, and brooms. Larger play structures, such as a playhouse, are also catalysts for their imagination. A miniature house may inspire a child to mimic their perceived environment by pretending to fill the role of a father or mother as they set about caring for their synthetic children or organizing a meal of plastic foods.

However, some structures, such as the aforementioned playhouse, are large, and although most parents and/or guardians would like to provide many, varied structures for children to play with, it becomes difficult to balance the space required to store unused, bulky play structures with the room necessary to effectively employ them during playtime. Accordingly, some play structures are collapsible to enable efficient storage when not in use, but while this collapsible feature may provide some benefit to reducing the geographic footprint of the play structure during periods of nonuse, this feature typically comes at a cost. A collapsible playhouse lacks the same structural integrity of a rigid, non-collapsible playhouse, and because of this, there are some unintended consequences. For example, a child playing with a collapsible playhouse may accidentally or unintentionally cause the structure to collapse while they are playing with it. At the very least, this is likely to cause the child frustration or disappointment, but it may also injure the child.

In addition to some of the foregoing unintended consequences, many play structures are configured to assemble into a pre-determined shape or structure, such as a playhouse, tent, or castle. This imposes limitations on the diversity of structures and possible configurations available when playing.

Accordingly, there are a number of disadvantages with play structures that can be addressed.

BRIEF SUMMARY

Implementations of the present disclosure solve one or more of the foregoing or other problems in the art with systems and kits for assembling and/or modifying blanket-based structures.

For example, implementations of the present disclosure include systems for assembling or modifying a blanket-based structure that includes an enclosure element having one or more attachment mechanisms fixedly attached to the enclosure element and configured to detachably associate with one or more environmental structures. The exemplary system additionally includes a plurality of connection features, a plurality of complementary connection, and a plurality of eyelets disposed along the perimeter of the enclosure element. The exemplary system additionally includes one or more weights selectively attachable to the enclosure element at one or more of: the attachment mechanisms, the plurality of connection features, the plurality of complementary connection features, the plurality of eyelets, or combinations thereof.

In one embodiment, the system additionally includes a detachable corner strap having a securing region fixedly associated to the enclosure element and a strap. The strap includes a first end associated with the enclosure element and a second end fixedly associated with an attachment patch, the attachment patch being detachably associated with the securing region such that when the attachment patch is detachably associated with the securing region, the detachable corner strap extends substantially diagonally across a corner of the enclosure element.

Accordingly, systems for creating blanket-based structures are disclosed.

This summary is provided to introduce a selection of concepts in a simplified form that are further described below in the Detailed Description. This summary is not intended to identify key features or essential features of the claimed subject matter, nor is it intended to be used as an indication of the scope of the claimed subject matter.

Additional features and advantages of the disclosure will be set forth in the description that follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible. The disclosure will be described and explained with additional specificity and detail through the use of the accompanying drawings in which.

DETAILED DESCRIPTION

Figure 1:
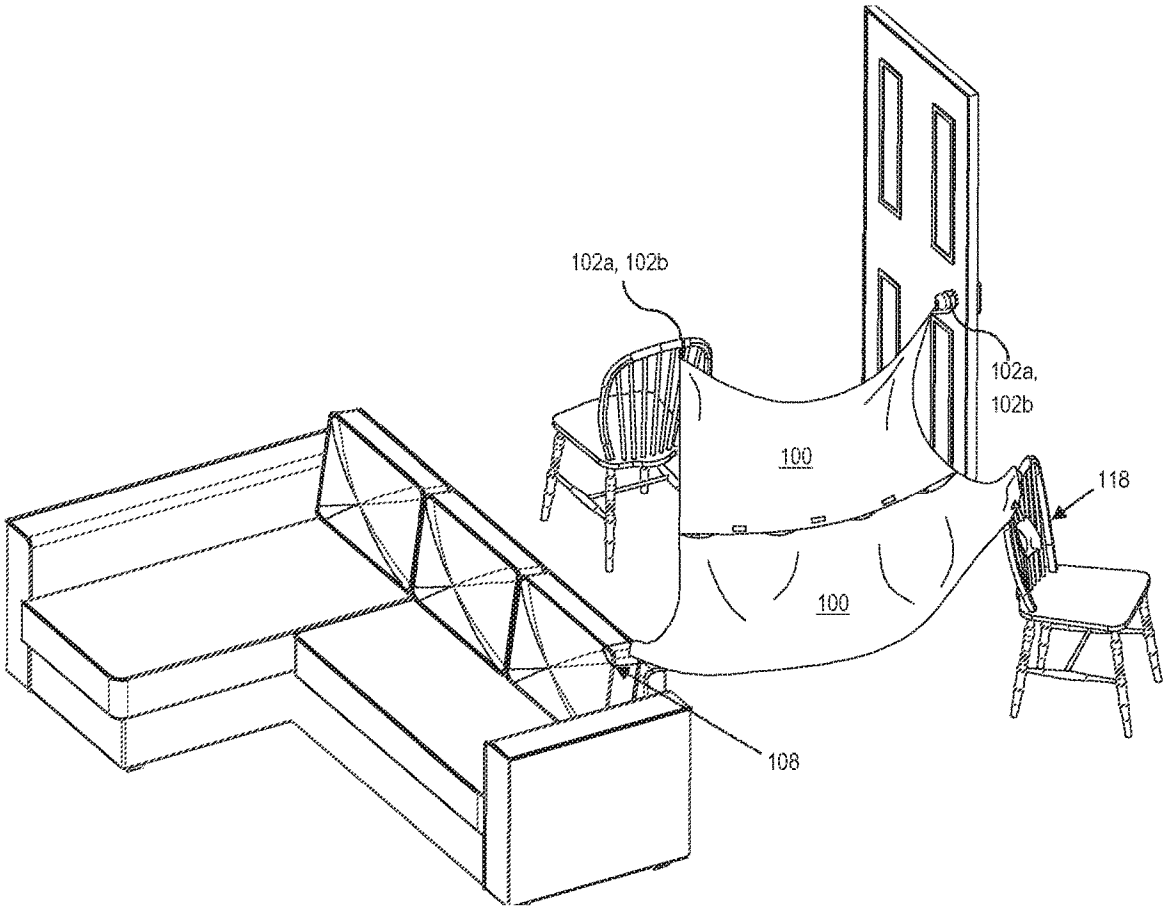
FIG. 1 illustrates a schematic representation of a blanket-based structure.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed invention.

Overview of Blanket-Based Structures

Children utilize many things to entertain themselves, including play structures of various sizes. At colloquial playgrounds, the play structures are large rigidly defined structures, and while these play structures may have movable parts such as swings, the entire structure, considered as a unitary whole, is stationary and immovable. Smaller play structures, such as those found at a child's home, may resemble larger structures that a child may have intimate or even passing familiarity with—a playhouse resembling an actual home or a miniature tipi representing the larger portable tent-like structure used by many Native American tribes of the Plains. In any case, the play structures are often large enough to allow the child to play within the structure, making the play structure bulky to store in its assembled state, and even if the play structure can be disassembled, it is nonetheless unwieldy and difficult to transport.

The inability or difficulty in transporting a play structure often impedes a child's ability to enjoy a specific toy, but it often is not a complete impediment to playtime. Children, after all, are creative and imaginative. In the absence of a pre-defined play structure, children will often construct an improvised fort out of household materials—blankets, couch cushions, pillows, etc. Blanket-based structures such as blanket forts are commonly improvised play structures, but there are well known and commonly experienced frustrations associated therewith. For example, blanket-based structures inherently lack elements to secure and support the structure, and while children may be creative, they often lack the architectural knowledge and foresight to create a stable structure. As a result, many ad hoc blanket-based structures suffer from structural instabilities and are liable to collapse at the slightest disturbance.

The lack of structural integrity found in many traditional blanket-based play structures often detracts from playtime or the use of blanket-based structures, generally. For example, a child may accidentally or unintentionally cause the structure to collapse while they are playing with it. This is particularly the case when the blanket-based play structure represents a fort or other refuge situated in whatever imaginary world a child has conjured while playing. The child is likely to run or otherwise hurriedly approach and enter the play structure, and given the lack of structural integrity, the play structure is liable to collapse or become deformed from unintended and/or abrupt contact. Such an occurrence is likely to detract from playtime and often engenders frustration or discouragement.

Embodiments of the present disclosure provide portable blanket-based play structures that address, at the very least, the aforementioned problems in the art of play structures, generally, and blanket-based play structures, particularly.

Embodiments and Implementations of Blanket-Based Structures

Embodiments of the present disclosure enable systems for creating blanket-based structures and kits for assembling and/or modifying the same.

For example, embodiments of blanket-based play structures are disclosed herein that employ one or more enclosure elements associated with one or more attachment mechanisms and/or selectively mounted weights to create and maintain a play structure in a desired configuration. In at least one embodiment, the enclosure element is connected to environmental support structures using a plurality of attachment mechanisms and/or detachable corner straps. The enclosure element may be associated with one or more detachable weights to add structural support and/or rigidity to the play structure so as to retain the play structure in the desired configuration.

FIG. 1 depicts an exemplary embodiment of a blanket-based structure utilizing a plurality of enclosure elements disclosed herein. While particular blanket-based structures are illustrated by the figures and accompanying text, they are exemplary only and are not intended to limit the uses or configuration in which the disclosed enclosure elements may be arranged. Accordingly, FIG. 1 illustrates enclosure elements 100 associated with a plurality of attachment mechanisms 102*a*, 102*b*, corner straps 108, and weights 118, which, in turn, are associated with environmental objects to anchor a portion of the enclosure element thereto. As can be appreciated in FIG. 1, and which is applicable to other embodiments of the present disclosure, anchoring one or more portions of enclosure elements 100 enables enclosure elements 100 to define a space. The space defined thereby may be considered a blanket-based structure, a play structure, or similar.

As illustrated in FIG. 1, various attachment mechanisms 102*a*, 102*b*, corner straps 108, and weights 118 may be associated with any number of environmental structures to anchor the enclosure element 100 thereto. For example, attachment mechanism 102*a*, 102*b*, which is depicted in FIG. 1 as a two-piece strap, is wrapped around or otherwise attached to a doorknob. The doorknob acts to anchor the associated corner of enclosure element 100. Additionally illustrated in FIG. 1, an attachment mechanism 102*a*, 102*b* is associated with a chair to anchor the enclosure element 100 and span the enclosure elements 100 between the doorknob and the chair, defining a space beneath. Corner strap 108 spans a corner of enclosure element 100 and may hook about an environmental structure or other object such as a corner of a couch or a mattress. As depicted in FIG. 1, corner strap 108 is hooked about a couch cushion, thereby anchoring the associated enclosure element 100 thereto.

A weight 118 may also be associated with an enclosure element 100 and may act to anchor a portion of the enclosure element 100 to an environmental structure. For example, FIG. 1 illustrates a weight 118 attached to the enclosure element 100 and slung over a chair. The weight acts to anchor the enclosure element, retaining at least the associated portion of enclosure element 100 at or near the location where the weight is deposited. Though not depicted in FIG. 1, a weight 118 may additionally, or alternatively, be associated with an enclosure element 100 and tossed on the ground where it acts to anchor a portion of the enclosure element 100 to the ground, similar to a stake.

The environmental objects depicted in FIG. 1 include chairs, doorknobs, and couches, but it should be appreciated that additional environmental objects are intended to be included within the scope of the present disclosure. For example, an environmental object could further include the leg and/or post of a bed, a mattress, ottomans, recliners, lounges, tables, coat racks, railings, benches, tables, or any other item that could reasonably serve to anchor a portion of an enclosure element.

The blanket-based structure and environmental objects depicted within FIG. 1 are provided in an indoor environment. However, it should be appreciated that embodiments of the present invention are not limited to indoor use or to association with environmental objects commonly found indoors. The systems and kits disclosed herein may be implemented outdoors for creating structures for play and/or as a temporary outdoor hovel. Therefore, outdoor implementations of the disclosed systems for assembling and/or modifying blanket-based structures may make use of environmental objects found outdoors that could serve a similar anchoring function to the indoor environmental structures described above. As non-limiting examples, environmental objects found outdoors may include a tree, a bench, a lamppost, a fence, outdoor play equipment (swing set, trampoline, jungle gym, etc.) or similar.

It should also be appreciated that systems and kits for outdoor use may be the same as those provided for indoor use, but they may also be different. For the purposes of this description, the term "enclosure element" is intended to include objects and materials that act to define, surround, and/or envelop a given area and/or volume of space. An enclosure element may comprise one or more of a non-woven or woven textile derived from animal (e.g., wool, silk, animal skin/fur, etc.), plant (e.g., hemp, cotton, flax, etc.), mineral (e.g., asbestos, glass fiber), synthetic material (e.g., nylon, polyester, acrylic, polyethylene, tarpaulin, etc.), or combinations thereof in any color, pattern, and/or organization. In some embodiments, the term "enclosure element" encompasses the term blanket insofar as enclosure elements, as used herein, are used in the creation of blanket-based structures. Enclosure elements for outdoor use may comprise, for example, weather-resistant fabrics such as canvas, vinyl, polyethylene, tarpaulin, or any other material known in the art suitable for outdoor use, whereas enclosure elements for indoor use may comprise lightweight fabrics such as linen, satin, spandex or similar.

Figure 2:
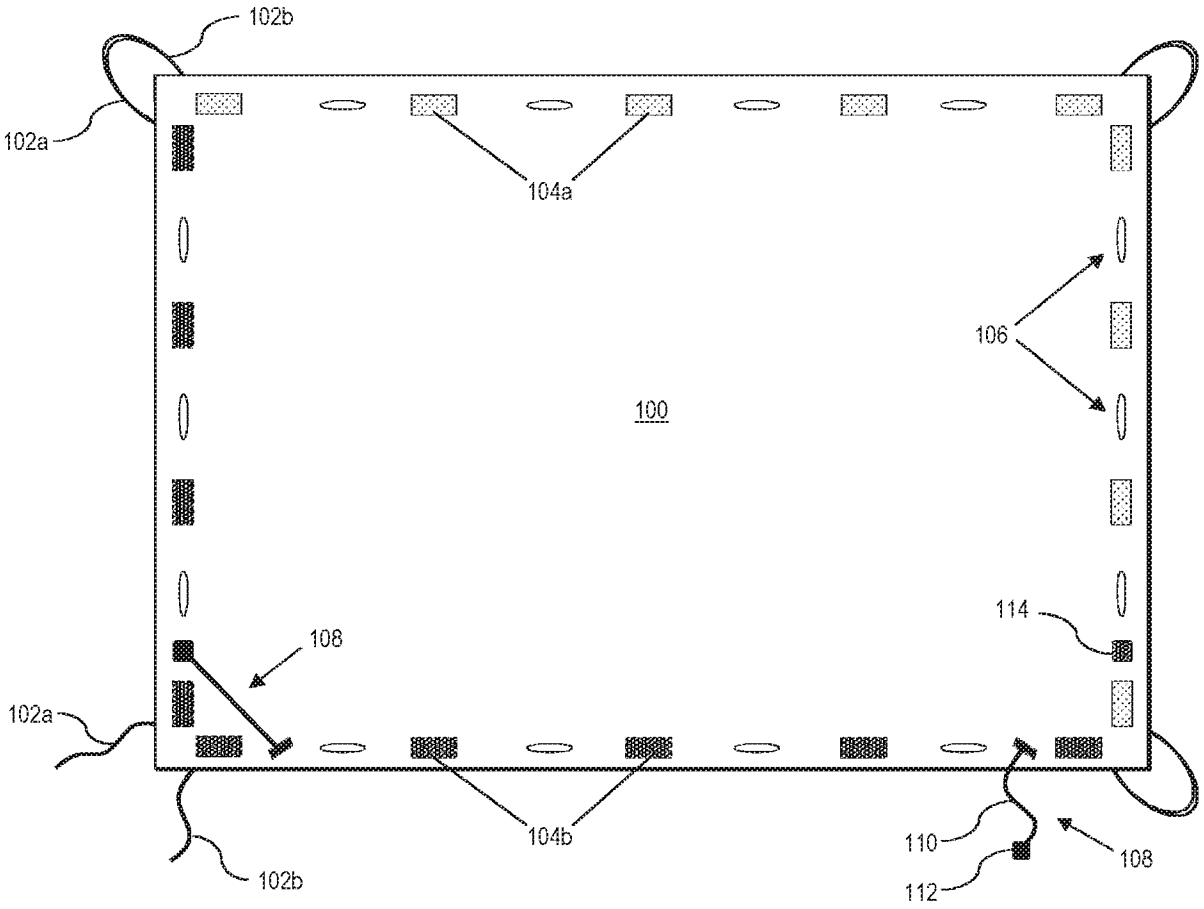
FIG. 2 illustrates a schematic representation of an enclosure element for use in constructing a blanket based structure.

Referring now to FIG. 2, illustrated is an exemplary enclosure element 100. An enclosure element may expand and/or retract, may bow and/or flex, and may entirely enclose a space, may substantially enclose a space, and/or may partially enclose and/or define a space. In some embodiments, the enclosure element may define a space such that the enclosure element forms one or more walls of the defined space. In some embodiments, one or more walls are open and/or are defined by another object. For example, the enclosure element may form a top wall and a side wall of a defined space while a second side wall is formed by another object and the ground defines a bottom surface of the space. In some embodiments, the enclosure element defines a bottom surface of the enclosed space. In some embodiments, the enclosure element defines only a top wall. In some embodiments, the enclosure element does not touch a bottom surface defined by the ground or other object but nonetheless generates the appearance of a defined or partially defined space.

The enclosure element 100 of FIG. 2 is depicted as a rectangle. However, enclosure elements of the present invention may be any shape or combination of shapes. An enclosure element may be any polygonal shape, such as triangles, quadrilaterals, pentagons, hexagons, heptagons, octagons, nonagons, decagons, or other polygon, it may be arcuate in shape (e.g., circular and/or elongate), or it may be any combination of polygonal and arcuate shapes.

The enclosure element 100 of FIG. 2 includes attachment mechanisms 102*a*, 102*b*, which as illustrated, are positioned each corner of enclosure element 100. The term "attachment mechanism," as used herein, includes any device in one or more pieces that may be used to "attach" two or more components or to "attach" one component to another component. The term "attach" and/or "attachment" may refer to its common dictionary definition where appropriate, but it may contextually refer to particular acts of connecting, associating, affixing, fastening, sticking, joining, or any combination of the foregoing that cause an object to be fixedly or selectively proximate another object. In some embodiments, an attachment mechanism may be an integral part of a component, whereas in other embodiments, an attachment mechanism may be separate. An attachment mechanism is to be understood to have any number of movable and/or fixed parts, any of which may be singularly or in combination with one or more components interact to facilitate attachment. As a non-limiting example, an attachment mechanism includes hook and loop fasteners, ties, buttons, and/or clips.

In one embodiment, the attachment mechanism 102*a*, 102*b* is fixedly attached to enclosure element 100, but it may, in some embodiments, be removably associated therewith (e.g., detachable straps). Further, attachment mechanism 102*a*, 102*b* of FIG. 2 is depicted as two straps removably associated with one another. Further still, in some embodiments, attachment mechanism 102*a*, 102*b* may be associated with enclosure element 100, at any position along the hedge of enclosure element 100 or within the body of an enclosure element 100. For example, an attachment mechanism may be placed at the center of enclosure element 100 and attached to a hanging structure to reduce the bowing of the enclosure element 100 or otherwise add height to a space defined by the enclosure element 100.

Also, the enclosure element 100 depicted in FIG. 2 includes connection features 104*a* and complementary connection features 104*b*. As illustrated, connection features 104*a* and complementary connection features 104*b* are provided in discrete portions around the perimeter of enclosure element 100. In one embodiment, connection features 104*a* and/or complementary connection features 104*b* may be provided as strips around the perimeter of enclosure element 100.

Connection features 104*a* and complementary connection features 104*b* are each illustrated as being disposed along two adjacent edges of enclosure element 100. In some embodiments, connection features 104*a* and/or complementary connection features 104*b* are disposed on a single edge of enclosure element 100, opposite edges of enclosure element 100, or all edges of enclosure element 100. Although the connection features 104*a* are illustrated in FIG. 2 as being disposed on a top side enclosure element 100 and complementary connection features 104*b* are illustrated as being disposed on the bottom side of enclosure element 100, it should be appreciated that any number of connection features 104*a* and complementary connection features 104*b* may be disposed on a top side of enclosure element 100 and/or a bottom side of enclosure element 100 and in any configuration.

Also, illustrated in FIG. 2 are a plurality of eyelets 106 disposed along the perimeter of enclosure element 100. In some embodiments, one or more of the plurality of eyelets 106 are slits in the enclosure element 100, which may be reinforced by stitching to prevent tearing. In some embodiments, at least a portion of the plurality of eyelets 106 are associated with grommets or additional supportive material to reinforce the eyelet. As used herein, the term "grommet" includes one or more edge strips inserted into an eyelet defined by a material to protect the structural integrity of the material from being torn or otherwise worn and/or broken. A grommet, therefore, is intended to include any element that reinforces an eyelet and/or slit and may be made of any suitable material known in the art, including, for example, metal, rubber, wood, and/or plastic.

Additionally, although FIG. 2 illustrates the connection features 104*a* or complementary connection features 104*b* as being equally spaced and alternating with eyelets 106 along the perimeter/edge of enclosure element 100, the eyelets 106 may, in some embodiments, be disposed along any number of perimeter edges or within an interior space of enclosure element 100 and in any number.

The enclosure element 100 further includes detachable corner straps 108. As illustrated in FIG. 2, the detachable corner strap 108 extends substantially diagonally across a corner of the enclosure element 100 and includes a strap 110 fixedly attached to enclosure element 100 at a first end and associated with an attachment patch 112 at a second end. The attachment patch 112 is configured to selectively and detachably connect to securing region 114. In one embodiment, attachment patch 112 and securing region 114 are a hook and loop system where, for example, attachment patch 112 includes the hook portion and securing region 114 includes the loop portion. In one embodiment, the corner strap is selectively detachable at both ends such that the strap includes attachment patches 112 at both the first and second ends, which are associated with securing regions 114 on the enclosure element 100. By being detachable from at least one end, the detachable corner strap 108 reduces the potential for asphyxiation. Any child (or other user) who purposely or inadvertently becomes entangled with corner straps 108 while it is attached at both ends to enclosure element 100 can easily break free before dangerously constrictive pressure is applied by the corner strap. Although depicted in FIG. 2 as being disposed at two adjacent corners on the same side of enclosure element 100, it should be appreciated that corner straps 108 may be on one or both sides of enclosure element 100 and may be positioned at any corner thereof.

Figure 3:
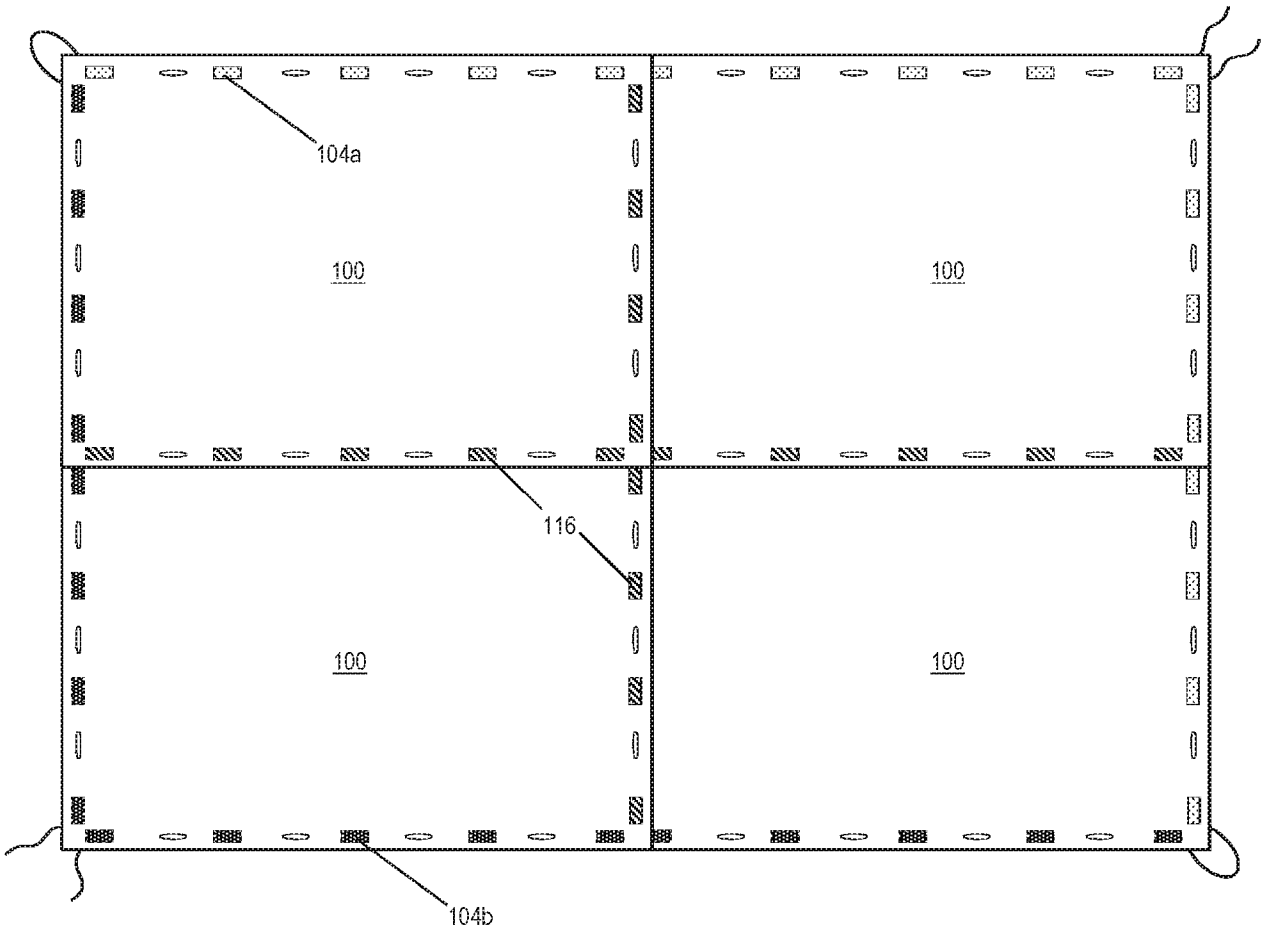
FIG. 3 illustrates a plurality of connected enclosure elements.

Referring now to FIG. 3, illustrated are four rectangular enclosure elements 100 that are associated together to form a larger rectangular enclosure element. Connection features 104*a* of a first enclosure element 100 associate with complementary connection features 104*b* of a second enclosure element 100 to form mating regions 116. The mating regions 116 include regions where two or more enclosure elements 100 are detachably associated with one another by connection features 104*a* and complementary connection features 104*b*. For example, the connection features 104*a* may include hooks of a hook and loop system that associate with, and thereby detachably connect to, complementary connection features 104*b* that comprise loops.

It should be appreciated that although FIG. 3 illustrates four enclosure elements 100 connected to form a larger, symmetric enclosure element, any number of enclosure elements of the present disclosure in any shape may be combined in any number of ways, and in any configuration, to form one or more larger enclosure elements, which may or may not be symmetric. Additionally, in some embodiments, the mating regions of connected enclosure elements are not isolated to the association of peripheral connection features 104*a* and peripheral complimentary connection features 104*b*. Rather, an interior connection feature 104*a* may be associated with a peripheral complementary connection feature 104*b* to form a mating region 116.

Additionally, or alternatively, in some embodiments, attachment mechanisms 102*a*, 102*b* are used to connect two or more enclosure elements 100. For example, a first strap of attachment mechanism 102*a*, 102*b* is passed through an eyelet 106 on a first enclosure element 100 and a second strap of attachment mechanism 102*a*, 102*b* is passed through an eyelet 106 on a second enclosure element 100. The first and second straps of attachment mechanism 102*a*, 102*b* are connected, thereby associating the two enclosure elements 100. Accordingly, and as provided within the scope of this disclosure, any number or type of attachment mechanisms 102*a*, 102*b*, connection features 104*a*, and complementary connection features 104*b* may be used to associate two or more enclosure elements 100.

Figure 4:
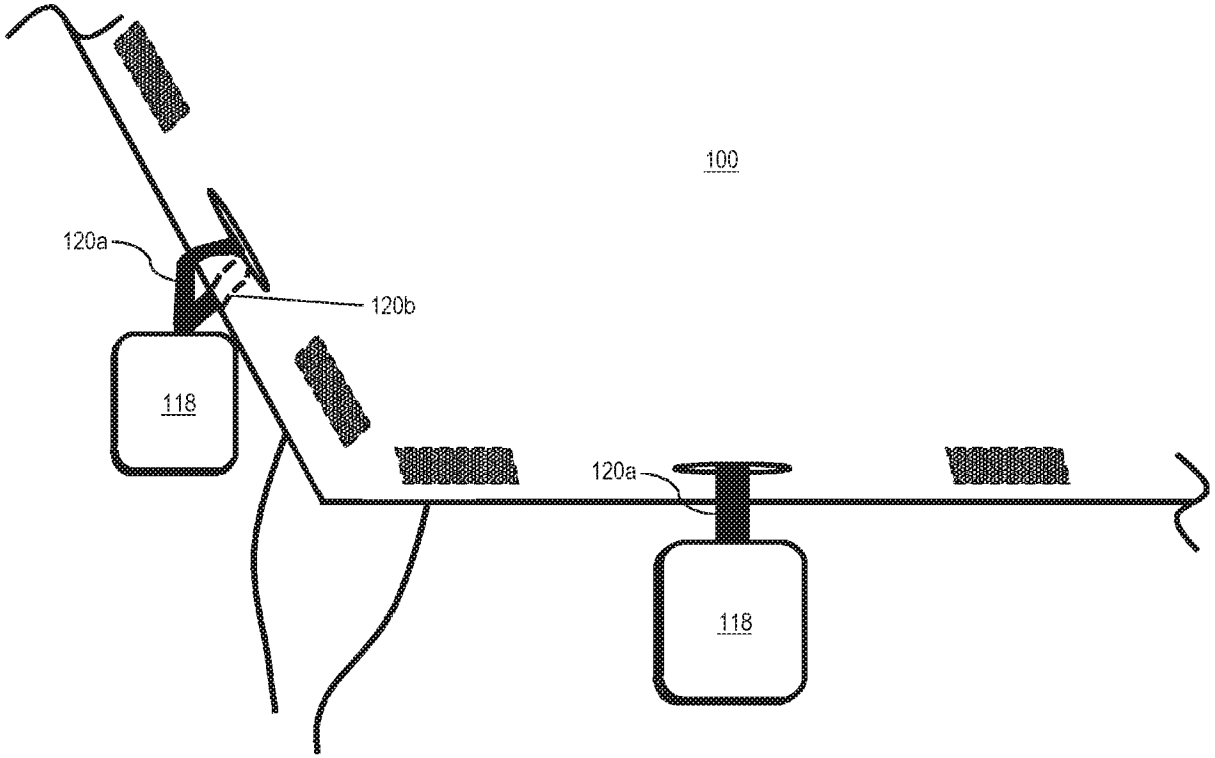
FIG. 4 illustrates weights associated with an edge portion of an enclosure element.

Referring now to FIG. 4, illustrated is an enclosure element associated with weights 118. In one embodiment, the weights 118 are selectively detachable from enclosure element 100 by securing straps 120*a*, 120*b*. The securing straps 120*a*, 120*b* preferably associate the weights 118 with the enclosure element 100 at eyelets 106. Nevertheless, in some embodiments, securing straps 120*a*, 120*b* may be associated with attachment mechanisms 102*a*, 102*b* to detectably secure the weights 118 to enclosure element 100. In some embodiments, detachably securing the weights 118 to the enclosure element 100 is advantageous because it allows at least a portion of the enclosure element 100 to be anchored at a location where the use of an attachment mechanism is improbable. For example, an edge of an enclosure element 100 may border the back side of a couch where no attachment mechanism is suitable to anchor the enclosure element. One or more weights 118 may be associated with one or more corresponding eyelets 106 of the enclosure element 100 and positioned on opposing side of the couch, thereby anchoring the enclosure element 100 along at least a portion of that edge.

In one embodiment, the weights 118 comprise beanbags. The weight of said beanbags, in some embodiments, is about 2 pounds. In some embodiments, the beanbags weigh greater than 0.5 pounds, greater than 1 pound, greater than 1.5 pounds, greater than 2 pounds, greater than 2.5 pounds, greater than 3 pounds, greater than 3.5 pounds, greater than 4 pounds, greater than 4.5 pounds, greater than 5 pounds, less than 5 pounds, less than 4.5 pounds, less than 4 pounds, less than 3.5 pounds, less than 3 pounds, less than 2.5 pounds, less than 2 pounds, less than 1.5 pounds, less than 1 pound, or comprise a weight within a range of weights defined by any of the foregoing upper and lower bounds. In some embodiments, a plurality of different weighted beanbags are provided. In yet other embodiments, the weights 118 comprise a selectively closable container that may be filled to a desired weight.

In some embodiments, any of the foregoing elements for assembling, modifying, and/or improving blanket-based structures may be provided as a kit.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein.

It will be noted that, as used in this specification and the appended claims, the singular forms "a," "an" and "the" include plural referents unless the context clearly dictates otherwise. Thus, for example, reference to a singular referent (e.g., "widget") includes one, two, or more referents. Similarly, reference to a plurality of referents should be interpreted as comprising a single referent and/or a plurality of referents unless the content and/or context clearly dictate otherwise. For example, reference to referents in the plural form (e.g., "widgets") does not necessarily require a plurality of such referents. Instead, it will be appreciated that independent of the inferred number of referents, one or more referents are contemplated herein unless stated otherwise.

As used herein, directional terms, such as "top," "bottom," "left," "right," "up," "down," "upper," "lower," "proximal," "distal," "adjacent" and the like are used herein solely to indicate relative directions and are not otherwise intended to limit the scope of the disclosure and/or claimed invention.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components.

While the detailed description is separated into sections, the section headers and contents within each section are not intended to be self-contained descriptions and embodiments. Rather, the contents of each section within the detailed description are intended to be read and understood as a collective whole where elements of one section may pertain to and/or inform other sections. Accordingly, embodiments specifically disclosed within one section may also relate to and/or serve as additional and/or alternative embodiments in another section having the same and/or similar systems, modules, devices, methods, and/or terminology.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects, however, are also contemplated herein.

The present disclosure may be embodied in other specific forms without departing from its spirit or essential characteristics. The described embodiments are to be considered in all respects only as illustrative and not restrictive. The scope of the invention, therefore, is indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A system for assembling or modifying a blanket-based structure, comprising:

an enclosure element, wherein the enclosure element comprises:

one or more attachment mechanisms fixedly attached to the enclosure element, the one or more attachment mechanisms configured to detachably associate with one or more environmental structures;

a plurality of eyelets disposed adjacent to the perimeter of the enclosure element; and one or more weights selectively attachable to the enclosure element by one or more securing straps at one or more of: the attachment mechanisms, the plurality of eyelets, or combinations thereof, such that the one or more weights are configured to be suspended from the perimeter of the enclosure element by the one or more securing straps.

2. The system as in claim 1, wherein the enclosure element is polygonal and comprises at least one corner.

3. The system as in claim 1, wherein at least one attachment mechanism of the one or more attachment mechanisms comprises a first strap and a second strap, the first strap being selectively securable to the second strap.

4. The system as in claim 3, wherein the at least one attachment mechanism is fixedly attached to the enclosure element at the at least one corner.

5. The system as in claim 1, wherein the enclosure element further comprises:

a plurality of connection features disposed along a perimeter of the enclosure element; and a plurality of complementary connection features disposed along the perimeter of the enclosure element.

6. The system as in claim 1, wherein the one or more attachment mechanisms comprise a plurality of straps disposed adjacent to the perimeter of the enclosure element.

7. The system as in claim 5, wherein the plurality of connection features are disposed along a first region of the perimeter and the plurality of complementary connection features are disposed along a second region of the perimeter, wherein the first region and the second regions are mutually exclusive.

8. The system as in claim 7, wherein the plurality of connection features are disposed on a top side of the enclosure element and the plurality of complementary connection features are disposed on a bottom side of the enclosure element.

9. The system as in claim 7, wherein the plurality of connection features and the plurality of complementary connection features are disposed in discrete portions.

10. The system as in claim 1, comprising a second enclosure element, the second enclosure element comprising one or more attachment mechanisms and a plurality of eyelets, wherein the one or more attachment mechanisms and/or the plurality of eyelets of the enclosure element are configured to detachably connect to the one or more attachment mechanisms and/or the plurality of eyelets of the second enclosure element.

11. The system as in claim 10, comprising an enlarged enclosure element, the enlarged enclosure element comprising the enclosure element and the second enclosure element detachably connected by the one or more attachment mechanisms and/or the plurality of eyelets of the enclosure element and the second enclosure element.

12. The system as in claim 1, wherein the plurality of eyelets comprises grommets.

13. The system as in claim 1, wherein the one or more weights are selectively attachable to the enclosure element by one or more securing straps.

14. The system as in claim 13, wherein the one or more weights comprise one or more beanbags, the one or more beanbags weighing within a range of greater than 0.5 pounds and less than 5 pounds.

15. The system as in claim 13, wherein the one or more weights comprise selectively closable bags configured to hold one or more weighted objects.

16. A kit for assembling or modifying a blanket-based structure, the kit comprising:

a plurality of enclosure elements, wherein each of the plurality of enclosure elements comprises:

one or more attachment mechanisms fixedly attached to the enclosure element, the one or more attachment mechanisms configured to detachably associate with one or more environmental structures or another enclosure element;

a plurality of eyelets disposed adjacent to the perimeter of the enclosure element; and one or more weights selectively attachable to the enclosure element by one or more securing straps at one or more of: the attachment mechanisms, the plurality of eyelets, or combinations thereof, such that the one or more weights are configured to be suspended from the perimeter of the enclosure element by the one or more securing straps.

17. The kit as in claim 16, wherein the one or more attachment mechanisms comprise a plurality of straps disposed about the perimeter of the enclosure element.

18. A system for assembling or modifying a blanket-based structure, comprising:

a plurality of polygonal enclosure elements, wherein each polygonal enclosure element of the plurality of polygonal enclosure elements comprises:

a plurality of attachment mechanisms fixedly attached to a perimeter of the polygonal enclosure element, the plurality of attachment mechanisms comprising a plurality of straps disposed about the perimeter of the polygonal enclosure element, the plurality of straps being selectively securable to the plurality of straps of another polygonal enclosure element or one or more environmental structures to detachably associate multiple polygonal enclosure elements together or with the one or more environmental structures;

a plurality of eyelets disposed adjacent to the perimeter of the enclosure element; and one or more weights selectively attachable to any of the plurality of attachment mechanisms or the plurality of eyelets by one or more securing straps, such that the one or more weights are configured to be suspended from the perimeter of the enclosure element by the one or more securing straps.

19. The system as in claim 18, wherein at least one enclosure element of the plurality of polygonal enclosure elements further comprises a plurality of connection features disposed along a perimeter of the enclosure element.

20. The system as in claim 19, wherein the at least one enclosure element further comprises a plurality of complementary connection features disposed along the perimeter of the at least one enclosure element.

* * * * *